US005158655A

United States Patent [19]

Townsend

[11] Patent Number: 5,158,655

[45] Date of Patent: Oct. 27, 1992

[54] COATING OF CATHODE SUBSTRATE DURING ALUMINUM SMELTING IN DRAINED CATHODE CELLS

[76] Inventor: Douglas W. Townsend, 492 Longtowne Ct., Glen Burnie, Md. 21061

[21] Appl. No.: 697,992

[22] Filed: May 10, 1991

Related U.S. Application Data

[63] Continuation-in-part of Ser. No. 294,781, Jan. 9, 1989, Pat. No. 5,028,301.

[51] Int. Cl.[5] ..... C25C 3/06; C25D 3/66

[52] U.S. Cl. ..... 204/67; 205/230

[58] Field of Search ..... 204/39, 64 R, 67, 290 R, 204/290 F, 243 R-247, 294; 205/230

[56] References Cited

U.S. PATENT DOCUMENTS 3,028,324 4/1962 Ransley ..... 204/67
3,697,390 10/1972 McCawley et al. ..... 204/39
4,243,502 1/1981 Kugler ..... 204/243 R
4,507,150 3/1985 Dube ..... 75/63
4,560,448 12/1985 Sane et al. ..... 204/67

*Primary Examiner*—Donald R. Valentine
*Attorney, Agent, or Firm*—Longacre & White

[57] ABSTRACT

The invention relates to a process of electrowinning molten aluminum from alumina dissolved in molten fluoride salts which are essentially cryolite. More specifically the process relates to placing refractory metal raised cathode structures in aluminum reduction cells and treating the raised cathode surfaces to coat them with refractory metal borides. This process deposits coatings composed of titanium diboride and other refractory metal borides on titanium and other refractory metal cathode structures from supersaturated elements dissolved in electrowon molten aluminum. The refractory metal boride coatings are resistant to penetration by the molten aluminum metal.

17 Claims, 5 Drawing Sheets

COATING OF CATHODE SUBSTRATE DURING ALUMINUM SMELTING IN DRAINED CATHODE CELLS

This application is a Continuation in Part of allowed U.S. application Ser. No. 07/294,781, now U.S. Pat. No. 5,028,301, filed Jan. 9, 1989, filed by the named inventor herein.

BACKGROUND OF THE INVENTION

The field of the invention is chemical and electrical processes for synthesizing metal from a fused bath and the present process is particularly concerned with electrowinning aluminum from a fused bath of cryolite and aluminum compounds.

The state of the art of the electrowinning process begins with U.S. Pat. No. 400,766 and the state of the art of the aluminum reduction cell useful in the present invention may be understood by reference to U.S. Pat. No. 3,400,061 and 4,093,524, the disclosures of which are incorporated herein by reference. Also incorporated by reference herein are U.S. Pat. Nos. 3,028,324; 3,067,124; 3,471,380; 4,333,813; 4,341,611; 4,466,995; 4,466,996; 4,526,911; 4,544,469; 4,560,448; 4,624,766 and European Patent Application 0 021 850 which show the state of the art of protecting cathodes from erosion during the electrowinning of aluminum.

U.S. Pat. Nos. 3,028,324, 3,471,380 and 4,560,448 disclose particular solutions of titanium in molten aluminum.

Most aluminum metal is smelted by being electrowon from alumina, $Al_2O_3$ dissolved in a molten salt electrolyte which is mostly cryolite, $Na_3AlF_6$ by a process little changed from that described by Hall (U.S. Pat. No. 400,766, 1889). This smelting process is often called the Hall process. The cryolite electrolyte usually also contains several percentage of each of aluminum fluoride, $AlF_3$ and calcium fluoride, $CaF_2$. The cryolite electrolyte may also contain several percentage of both magnesium fluoride, $MgF_2$, and lithium fluoride, LiF. The electrolyte fills most of the bottom part of the cavity of the cell including the vertical gap between the cathodes and anodes. The electrowinning smelting process is carried out at temperatures that may be as low as 920° C. and or as high as 1000° C. The usual operating temperature range is from 950° C. to 975° C. Conventional aluminum smelting cells are well described in THE ENCYCLOPEDIA OF ELECTROCHEMISTRY, Reinhold Publishing Corporation, New York, 1964. These conventional cells are constructed with carbon anodes and in modern cells, carbon block cathodes, called in the industry "cathode blocks." Carbon blocks line the cathode and hold a cathode pool, often called the cathode pad in the industry, containing up to 12 tons of molten aluminum metal that serves electrochemically as the actual cathode. The whole structure, including the carbon cathode blocks, steel electrical current conductors, insulation, and steel pot shell is known in the industry as the "cathode." The anode is geometrically above the cathode by virtue of the fact that cryolite is slightly lighter than aluminum. It floats on top of the molten aluminum metal and washes around the carbon anodes. The anodes are chemically attacked in the electrowinning smelting process and must be individually replaced every two to three weeks. Cathodes must last the expected 3 to 5 year life of the cell.

The pool of molten aluminum is called the cathode or metal pad. In conventional aluminum reduction cells, the metal cathode pool ranges in depth from 5 to 30 centimeters to produce enough hydrostatic pressure to force the molten metal pool into electrical contact with the surface of the carbon cathode blocks. This is necessary because molten aluminum poorly wets the surface of the carbon cathode substrate. Electrical contacts are made with areas of the carbon surface that are momentarily free of electrically insulating materials. At any given moment there are only relatively small areas with good electrical contact between the aluminum pool and the cathode blocks. The remainder of the interface is insulated by a thin layer of molten cryolite, deposits of undissolved alumina ore, and by aluminum carbide, which is a poor electrical conductor. Aluminum carbide readily forms by chemical reaction between molten aluminum metal and carbon of the cathode blocks wherever the two are in contact. Aluminum carbide is somewhat soluble in cryolite electrolyte. It is dissolved away by a layer of cryolite electrolyte, that is normally found between most areas of the metal pool and the carbon cathode despite the hydrostatic pressure exerted by the pool of molten aluminum. Cryolite, not aluminum, prefers to wet carbon and aluminum carbide surfaces. Cryolite is continuously dragged between the aluminum pool and the carbon cathode by motion of the aluminum pool. All areas of the cathode block carbon surface are periodically eaten away by the process of reacting with aluminum metal to form aluminum carbide which is dissolved away by molten cryolite. Wherever aluminum carbide is dissolved away, the carbon cathode blocks may again come briefly into electrical contact with the molten metal of the cathode pool. The carbon surface of the cathode is thus steadily eroded away at rates of from 1 to 5 centimeters per year.

The direct electrical current flowing through current conductors to the cells generates complex magnetic fields that interact with the electrical current flowing in the aluminum pool to cause high velocities in the aluminum pool and to generate waves on its surface. Some waves run from side to side, others from end to end while others rotate around the perimeter of the pot. It is most difficult and expensive to reduce the intensities of the various components of the magnetic field in existing smelters to reduce metal motion and allow the anodes to be moved closer to the cathode. The top surface of the molten aluminum metal cathode pool is covered by standing and moving waves. The tops of the metal waves tend to short circuit the aluminum electrowinning process by making electrical short circuit paths between the anodes and the cathode pool. Such shorting results in losses of 6% to 20% in current efficiency in the aluminum smelting process. Most existing smelters have current efficiencies that range from 78% to 90% out of the possible 98% that can theoretically be obtained. The current efficiency is measured by the total amount of metal actually collected from the cell, divided by the amount that could have been collected if one aluminum atom were produced for every three electrons that flow through the cell.

To reduce electrical shorting and thereby increase current efficiency, the vertical distance between the anodes and the cathode is usually maintained at about 5 centimeters. Cryolite based electrolyte in the gap between the cathode and anodes has an electrical resistivity of about 0.42 ohm-cm and carries a direct electrical current of between 0.7 and 1.5 Amperes/$cm^2$. The electrical current flowing through the cryolite electrolyte in the gap between the anode and the cathode generates heat, and wastes large amounts of electrical power. The height of the waves on the aluminum pool has been reduced in some of the more recently constructed smelters by computer aided design of the array of electrical conductors that together generate a complex magnetic field pattern in the aluminum pool.

One possible way to prevent the molten aluminum metal from forming surface waves is to remove the metal pool from the cathode surface and to smelt aluminum on raised solid cathode surfaces. An example of this design of aluminum smelting cell is illustrated by Lewis et al (U.S. Pat. No. 3,400,061). Reduction of the vertical gap between the cathodes and anodes to 1 to 2 centimeters can save from 2 to 4 kilo Watt hours of power per kilogram, of aluminum production. This is up to 25% of the power normally required to smelt aluminum by the Hall process. Cell current efficiencies in drained cathode cells are from 5% to 20% greater than in conventional cells. An additional benefit from a drained cathode cell is a decrease of cell polarization of up to about 0.5 volts. The raised cathode surface of a drained cathode cell must be covered by a coating that is readily wetted by the molten aluminum. The coating must not be significantly attacked by either the molten cryolite or molten aluminum during operation of the cell. This coating must last from three to five years to give the cell an economically long life. Carbon may be used as a cathode substrate, but is not useful as the actual cathode surface because it is not spontaneously wetted with molten aluminum and suffers rapid erosion when alternately contacted with aluminum metal and cryolite.

The desire to reduce the electrical power consumption in the smelting of aluminum has resulted in many conceptual designs for aluminum reduction cells and the construction of a few prototype production cells having solid cathode surfaces drained of aluminum metal. For such a cell to smelt alumina efficiently, aluminum metal must easily wet raised solid cathode surfaces so that the electrowon aluminum metal sticks to the cathode surface and drains off into collection areas away from the drained cathode surfaces without being carried off into the cryolite electrolyte as tiny droplets, as is the case when one attempts to smelt aluminum on drained carbon cathode surfaces.

Titanium diboride, $TiB_2$ has been identified as a material ideally suited to form the solid cathode surface, Ransley (U.S. Pat. No. 3,028,324, 1962). Whenever titanium diboride is mentioned in this application, it must be understood that the borides of Groups IV-B, V-B and VI-B of the periodic table which include the borides of the elements; titanium, zirconium, hafnium, chromium, vanadium, niobium, tantalum, chromium, molybdenum, and tungsten and mixtures thereof may be substituted for titanium diboride. Titanium diboride and similar diborides are wetted by aluminum metal, are excellent electrical and thermal conductors and are sparingly soluble in both molten aluminum metal and cryolite based electrolytes.

Some prior United States Patents have attempted to provide aluminum wetted drained cathode surfaces by covering structural cathode carbon blocks with tiles made from titanium and zirconium diborides; Lewis et al (U.S. Pat. No. 3,400,061), Payne (U.S. Pat. No. 4,093,524) and Kaplan (U.S. Pat. No. 4,333,813 and U.S. Pat. No. 4,341,611). Attempts have been made to coat carbon cathode surfaces of drained cathode aluminum reduction cells with smeared coatings composed of titanium diboride mixed with carbon cement; Boxall et al (U.S. Pat. No. 4,544,469; 4,466,692; 4,466,995; 4,466,996; 4,526,911; 4,544,469 and 4,624,766). Attempts have also been made to electroplate titanium diboride coatings on the surface of the carbon cathode substrate prior to producing aluminum metal; Biddulph (European Patent Application 0 021 850).

The various arts found in all previous patents have not yet been commercially successful in providing a durable aluminum wetted cathode surface that is resistant to both molten aluminum metal and cryolite electrolyte. The titanium diboride cathode surface produced by each art suffers from at least one of the following failure mechanisms: the coating material is attacked by aluminum metal or cryolite electrolyte; preformed structural shapes are cracked and broken by rough handling or by stresses caused by uneven thermal expansion during cell start-up; a difference in the coefficient of thermal expansion between the coating and carbon cathode substrate combined with attaching the coating material at room temperature by a cement that becomes brittle at a temperature well below the cell operating temperature results in shear stresses that cause the tiles to disbond; or the carbon cement is chemically attacked by aluminum metal then dissolved by cryolite electrolyte.

Most patented cathode coating systems for aluminum smelting are based on preformed structures containing titanium diboride and carbon cement or brittle mechanical fasteners to attach preformed structures to the carbon cathode substrate. Preformed structures may be pure titanium diboride or mixtures of titanium diboride and bonding materials such as carbon and aluminum nitride. Cements used to attach tiles to the carbon cathode substrate are usually various formulations of carbon cement. The cement joint is subject to fracture while the cell is being heated up to the 970° C. operating temperature, due to stresses resulting from the large difference between the coefficients of thermal expansion between titanium diboride and amorphous and graphitic forms of carbon cathode blocks used to construct aluminum smelting cells. Large shear stresses may develop between titanium diboride preformed structures and the carbon cathode structure because carbon has a lower coefficient of thermal expansion than has titanium diboride. Shear stresses can cause the cement joint to fail and titanium diboride structures to disbond from the cathode blocks, even before the cell starts to operate. These cells can be heated only by slow and careful procedures that properly dry, cure and carbonize the carbon cement to prevent titanium diboride structures from being mechanically damaged by cracking or spalling by stresses resulting from temperature gradients.

If a titanium diboride coating is installed in a cell when it is constructed, special care is required to prevent air from burning carbon cement and titanium diboride during the heating step. Typical means of heating cells for start up are to use oil or gas burners to preheat the cathode surface over a period of 8 to 24 hours to a temperature of about 800° C., while the cathode surface is protected by an inert or chemically reducing material such as a layer of crushed frozen cryolite electrolyte or coke to exclude air. Alternately, the cathode surface can be protected while being heated by the electrical resistance of a layer of coke placed between the anode and the cathode while direct electrical pot line current is passed between the cathode and anodes to slowly heat the cell over a period of a day or two. When the cell reaches a temperature of about 800° C., molten cryolite may be pored into the cell and the process of electrowinning aluminum started. Heat generated by cell electrical resistance and polarization associated with electrowinning aluminum is used to further heat the cell to the equilibrium operating temperature. While the cell smelts aluminum metal at its normal temperature, a balance is maintained between electrical heat generated, heat used by the process and thermal losses. This heat balance is maintained by opening and closing the gap between the anodes and cathodes.

Any cement that holds titanium diboride structures to the carbon cathode substrate that survives cell start up is usually rapidly attacked during cell operation by aluminum and cryolite, by the same processes that attack the carbon cathode surface of a conventional aluminum smelting cell. Aluminum metal also tries to wet the back side of titanium diboride structures causing it to disbond from the carbon cement while converting the carbon cement to aluminum carbide. Cryolite tries to wet the carbon cement and dissolve any aluminum carbide formed from the carbon cement by chemical reaction with the penetrating aluminum metal. Carbon cements react more readily with aluminum to form aluminum carbide than do cathode carbon blocks that are baked at a much higher temperature.

The carbon blocks of the cathode substrate normally undergo from 0.2% to 2% swelling in volume during the first 60 days of cell operation as electroreduced sodium and lithium metals dissolved in the molten aluminum intercalate into the carbon matrix and fluoride salts are absorbed. Any cathode coating system must either swell at the same rate as the carbon blocks or else be able to withstand stresses caused by the expansion of the cathode blocks.

Structural shapes containing titanium diboride and carbon cement that are sintered at temperatures above about 1500° C. are very hard and brittle. These materials are generally too brittle to withstand the incurred stresses and suffer breakage and disbondment from the cathode substrate during carbon cement sintering, cell start up, and normal operation. These structures are also extremely expensive to fabricate and install in the cell.

Another approach to making an aluminum wetted cathode surface is to mix either coarse chunks or finely divided titanium diboride with carbon cement or pitch to form a carbon matrix containing dispersed titanium diboride particles. This wet mixture may be spread onto the cathode surface when building the cell and baked by warming the cell cathode. Alternately this material may be baked into structural shapes at temperatures below 1500° C. and then cemented to the carbon cathode substrate. The resulting material is softer but tougher than titanium diboride preformed structures and generally adheres to the cathode blocks during cell start up. This material however fails rapidly during cell use because molten aluminum penetrates the coating and chemically reacts with the carbon matrix to form aluminum carbide. Aluminum carbide forms first on the top surface and along cracks in the coating. Considerable mechanical expansion occurs during the formation of aluminum carbide since aluminum carbide occupies about four times the volume of the carbon required to form it. As aluminum carbide forms along cracks and as aluminum carbide is dissolved by the cryolite, the coating rapidly disintegrates. Titanium diboride-carbon cathode surface coatings have little resistance to erosion by molten cryolite based electrolytes. These coatings are rapidly attacked by carbon dioxide bubbles that may be periodically swept against its surface. The coatings may fail mechanically by a freeze-thaw mechanism when cryolite freezes on the cathode surface as cold anodes are introduced into the cell every two to three weeks. Both carbon dioxide attack and freeze-thaw damage is more likely when an anode is inadvertently set lower into the cathode cavity than was intended.

No smeared coating or attached preformed structure can be repaired or replaced without freezing the cryolite and shutting the cell down. Cell freezing greatly reduces operating life. Any practical cathode surface coating must be able to withstand mechanical abuse that is normal to cell operation. This includes being poked by steel bars and other tools used to work the cell and make measurements, anodes dropping on the cathode surface, alumina ore deposits that may from time to time fall onto and even freeze to the cathode surface, cryolite electrolyte freezing, occasional burning by carbon dioxide bubbles, electric arcing caused by short circuiting, as well as erosion from cryolite electrolyte. After about 15% of the drained cathode surface area has lost its aluminum wetted coating, the cell looses so much current efficiency that it is no longer economical to operate.

SUMMARY OF THE INVENTION

The present invention relates to novel cathode structures made of refractory metals and alloys thereof which are placed in aluminum reduction cells and are protected from dissolving in molten aluminum metal by being coated with refractory metal borides. A thin laminar film of aluminum film, believed be about 0.012 centimeters thick, wets both the refractory metals and the refractory metal boride coatings thereon and drains off the cathode surface.

The refractory metals are found in Groups IV-B, V-B and VI-B of the periodic table of elements. These metals are called refractory metals because of their very high melting temperatures. They comprise titanium, zirconium, hafnium, chromium, vanadium, niobium, tantalum, molybdenum and tungsten. Whenever titanium is mentioned in this patent it is understood that the metals of Groups IV-B, V-B and VI-B of the periodic table of elements and mixtures thereof are meant as the equivalent of titanium metal. Refractory metal alloys may also may be substituted for titanium metal.

This invention also comprises the dissolution of small concentrations of ions of the refractory metal or metals that comprises the cathode structures and boron ions into the cryolite electrolyte and codepositing the respective refractory metal or metals and boron into the laminar film of aluminum metal that wets the refractory metal cathode surfaces and causes refractory metal boride coatings to form therefrom. This novel coating method is possible only because any desired degree of supersaturation of sparingly soluble refractory metals and boron can be continuously electrowon along with aluminum at a constant temperature onto the top surface of the thin laminar film of molten aluminum metal on the cathode surfaces. A laminar film of molten aluminum metal, containing co-deposited trace concentrations of refractory metal and boron, is continuously electrowon on the cathode surface in accordance with the invention. The aluminum film wets the refractory metal surface and the refractory metal boride coating. Because the thin laminar film of molten aluminum metal is relatively free of suspended tramp nuclei onto which metal borides can grow and is intentionally kept at a supersaturation level below the concentration where spontaneous nucleation of refractory metal boride particles are probable and because the laminar film of molten aluminum is relatively thin and is therefore free from convective and electromagnetic mixing, refractory metal boride deposits can be continuously grown as a uniform smooth coating on the refractory metal cathode substrates. The refractory metal and boron atoms must diffuse through the molten laminar film of aluminum metal and compete with adsorbed aluminum metal atoms for growth sites on the surface of the refractory metal and refractory metal boride coatings.

The physical process of growing refractory metal boride coatings from a thin film of molten metal is previously unknown and is hereby designated "supersaturation plating." The method produces deposits of the required refractory metal boride and borides for each respective refractory metal cathode substrate. On refractory metal alloy cathode substrates, the deposited coating contains the principle refractory metal boride or borides contained in the alloy. On a titanium cathode substrate, titanium borides should be formed. Zirconium borides should be formed on a zirconium substrate, and so on for each refractory metal and alloy substrate.

BRIEF DESCRIPTION OF THE DRAWINGS

Reference is made to the appended drawings that illustrate the chemistry of aluminum, boron, and titanium and possible designs of aluminum reduction cells employing the novel refractory metal cathode structures and refractory metal boride coating process of the present invention.

PREFERRED EMBODIMENTS OF THE INVENTION

Figure 1:
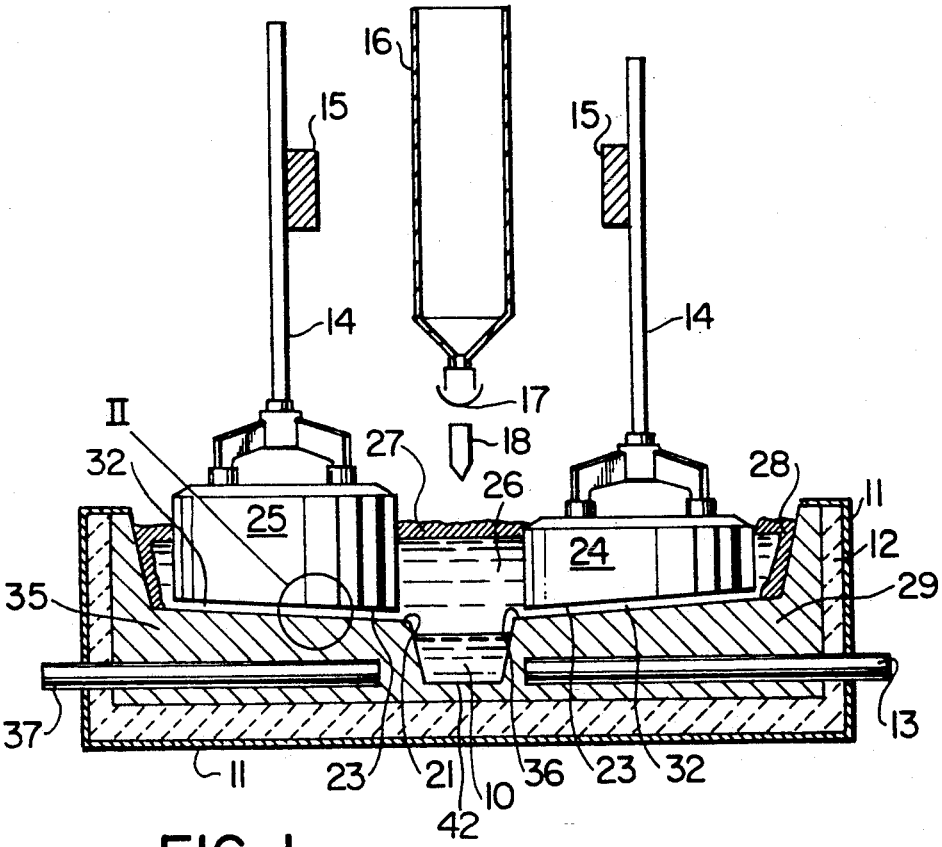
FIG. 1 is a vertical section through a drained cathode aluminum reduction cell employing refractory metal cathode plates attached to sloped carbon substrates.

With particular reference to FIG. 1, one configuration of drained cathode aluminum reduction cell is illustrated that comprises a steel shell 11 having a layer of suitable refractory insulation 12 and a cathode structure comprising prebaked carbonaceous blocks 29 and 35. Cathode electrical current collector bars are illustrated as 13 and 37 set into the carbon cathode blocks 29 and 35. Carbonaceous prebaked anodes 24 and 25 are hung into the cell cavity from electrically conductive anode hanger rods 14, which are in electrical contact with anode electrical bus bars 15 from which they are supported. The cell is filled with molten cryolite electrolyte 26 and 32 except for a layer of frozen cryolite 27 and 28 covering the perimeter of the carbon cell cavity above the level of the cathode surfaces 21 and 36 and accumulated electrowon aluminum metal 10 held in a well 42 formed between the cathode blocks 29 and 35. The bottom surfaces of the carbon anodes 24 and 25 are shaped to correspond to the top surfaces of the cathodes 21 and 36. The top surfaces of the carbon structures have refractory metal plates attached by refractory metal screws.

Figure 2:
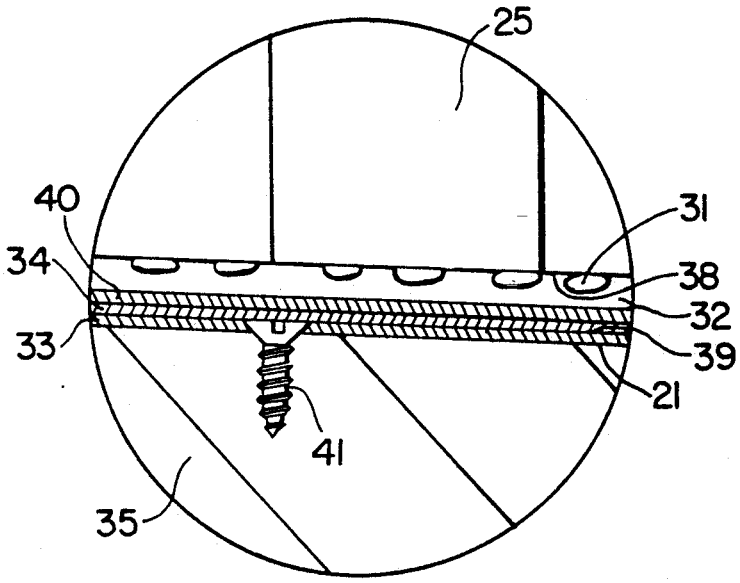
FIG. 2 is a detailed vertical section through a portion of FIG. 1 circled at II.

FIG. 2 shows the thin laminar film of molten aluminum 40, a titanium diboride layer 34, and the carbon cathode structure 35, in greater detail. The top surface 21 of the sloped cathode carbon structure 35 is covered by a layer of titanium 33, which in turn is covered by a layer of titanium diboride coating 34, formed from trace concentrations of titanium and boron, deposited by the process of supersaturation plating from a laminar thin film of molten aluminum. The layer of titanium 33 is attached by titanium screws 41 to the carbon cathode structure 35. Within the vertical distance from the top surface of the laminar film of molten aluminum metal 40 on the cathode to the bottom surface 38 of the anode 25 is a layer of cryolite electrolyte 32 which is urged up the slope by a gas lift pumping action caused by the buoyancy of the carbon dioxide bubbles 31 created by electrolysis of the carbon anode 25.

Figure 3:
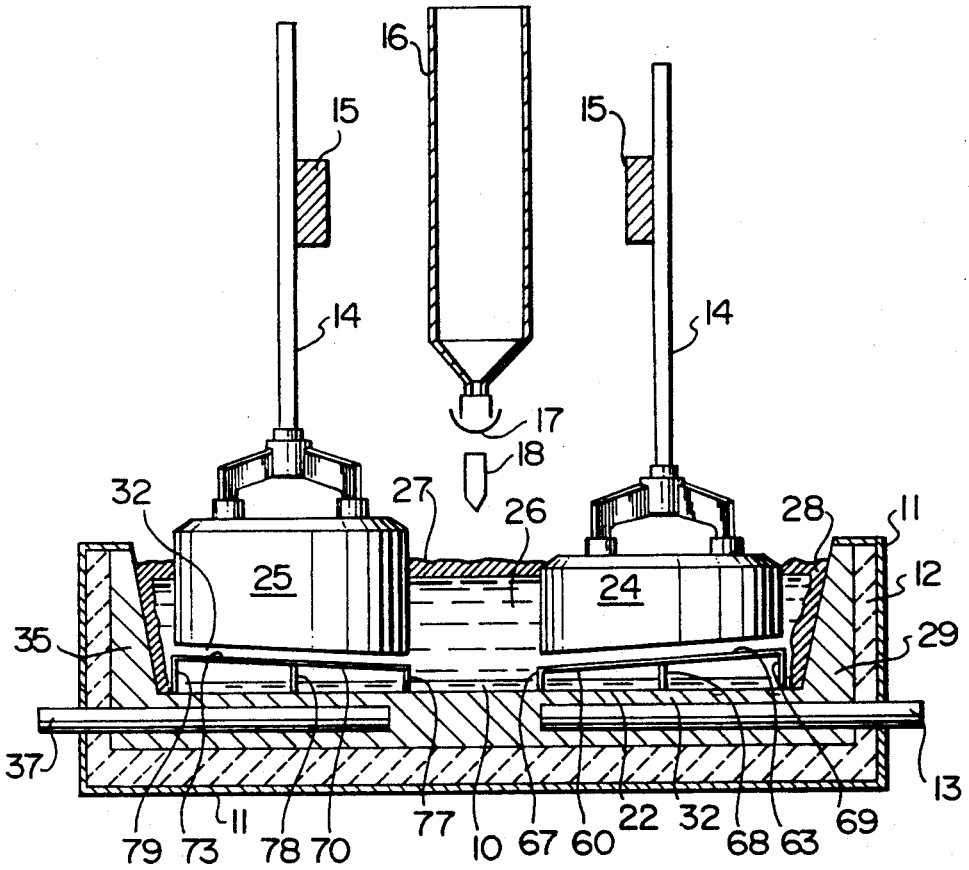
FIG. 3 is a vertical section through a drained cathode aluminum reduction cell employing free standing sloped refractory metal cathode structures, standing on a horizontal carbon substrate.

FIG. 3 depicts a configuration of a drained cathode aluminum reduction cell that comprises a steel shell 11 having a layer of suitable refractory insulation 12 and a cathode structure comprising prebaked carbonaceous blocks 29 and 35. Cathode electrical current collector bars are illustrated as 13 and 37 set into the carbon cathode blocks 29 and 35. Carbonaceous prebaked anodes 24 and 25 are hung into the cell cavity from electrically conductive anode hanger rods 14, which are in electrical contact with anode electrical bus bars 15 from which they are supported. The cell is filled with molten cryolite electrolyte 26 and 32 except for a layer of frozen cryolite 27 and frozen cryolite layer 28 covering the perimeter of the carbon cell cavity and accumulated electrowon aluminum metal 10 that washes around the legs 67, 68, 69, 77, 78, 79 of the titanium cathode structures 60 and 70. The bottom surfaces of the carbon anodes 24 and 25 are shaped to correspond to the top surfaces of the cathodes 63 and 73.

Figure 4:
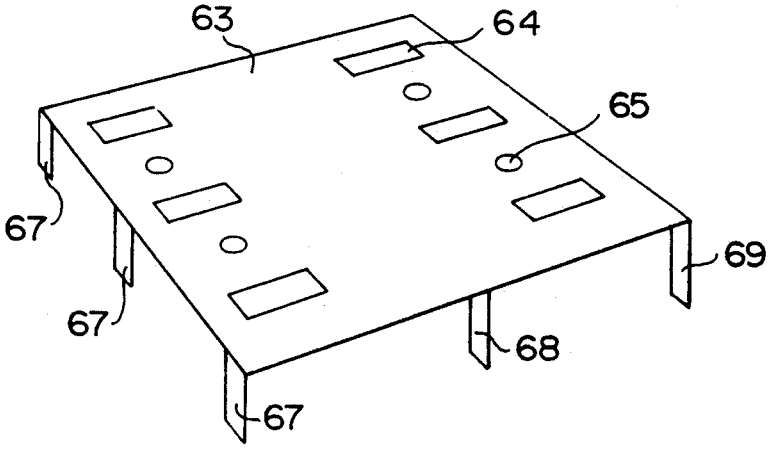
FIG. 4 shows a free standing refractory metal cathode structure that may be placed in an aluminum reduction cell illustrated in FIG. 1.

FIG. 4 shows one configuration of a titanium drained cathode substrate 60 with legs 67, 68 and 69 of various lengths, to give the top cathode surface 63 a slope with respect to the bottom of a flat cathode cavity and to leave space for the accumulation of aluminum metal and cryolite bath. The top surface 63 has a multiplicity of round holes 65 and/or slots 64 or other shaped holes through which aluminum metal may drain and cryolite bath may circulate.

Figure 5:
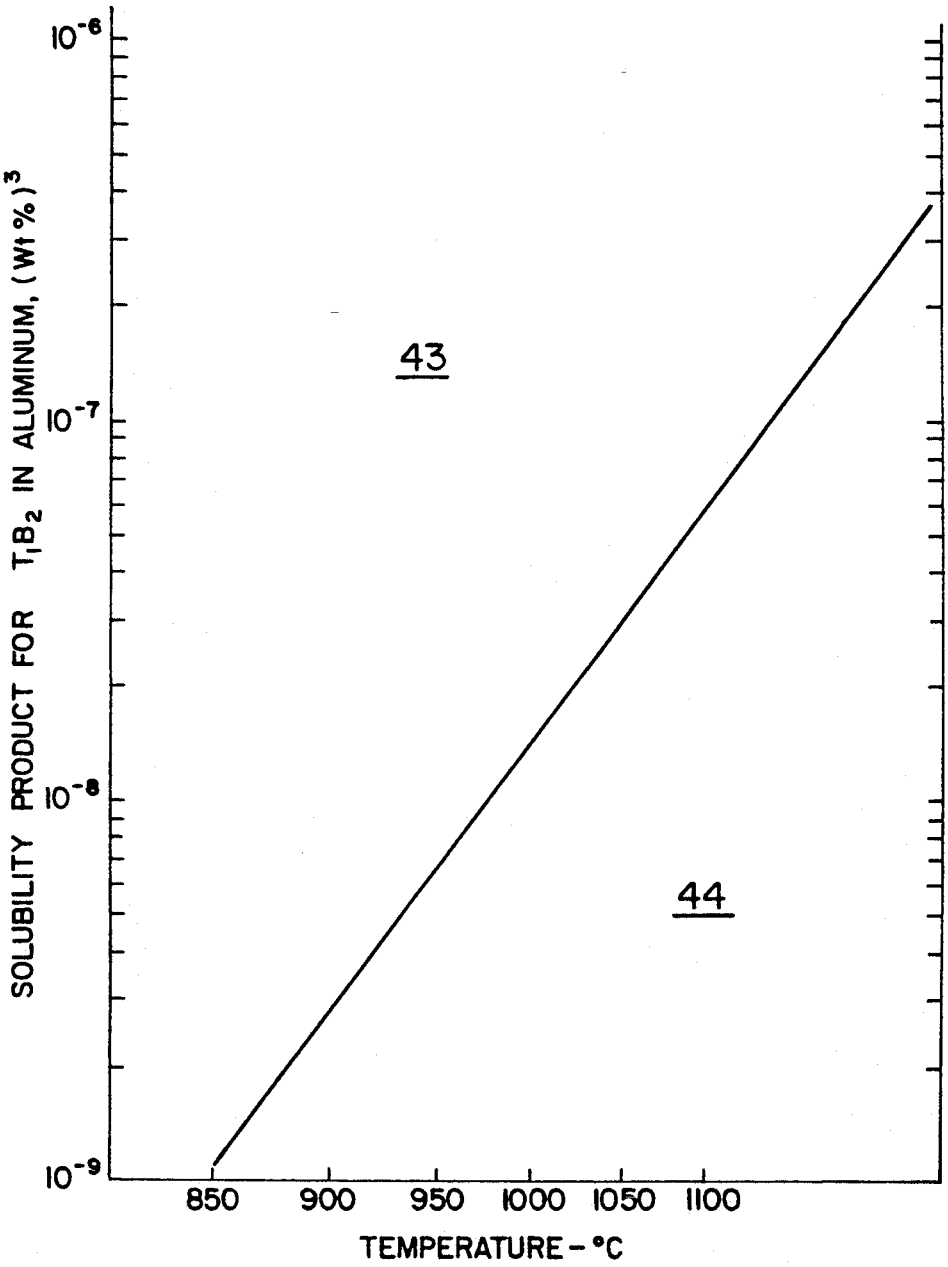
FIG. 5 shows the solubility product of titanium diboride expressed as weight percent titanium times the square of the weight percent boron dissolved in molten aluminum as a function of temperature.

FIG. 5 shows the solubility product of titanium diboride in aluminum metal as a function of temperature, plotted semilogarithmicly.

Figure 6:
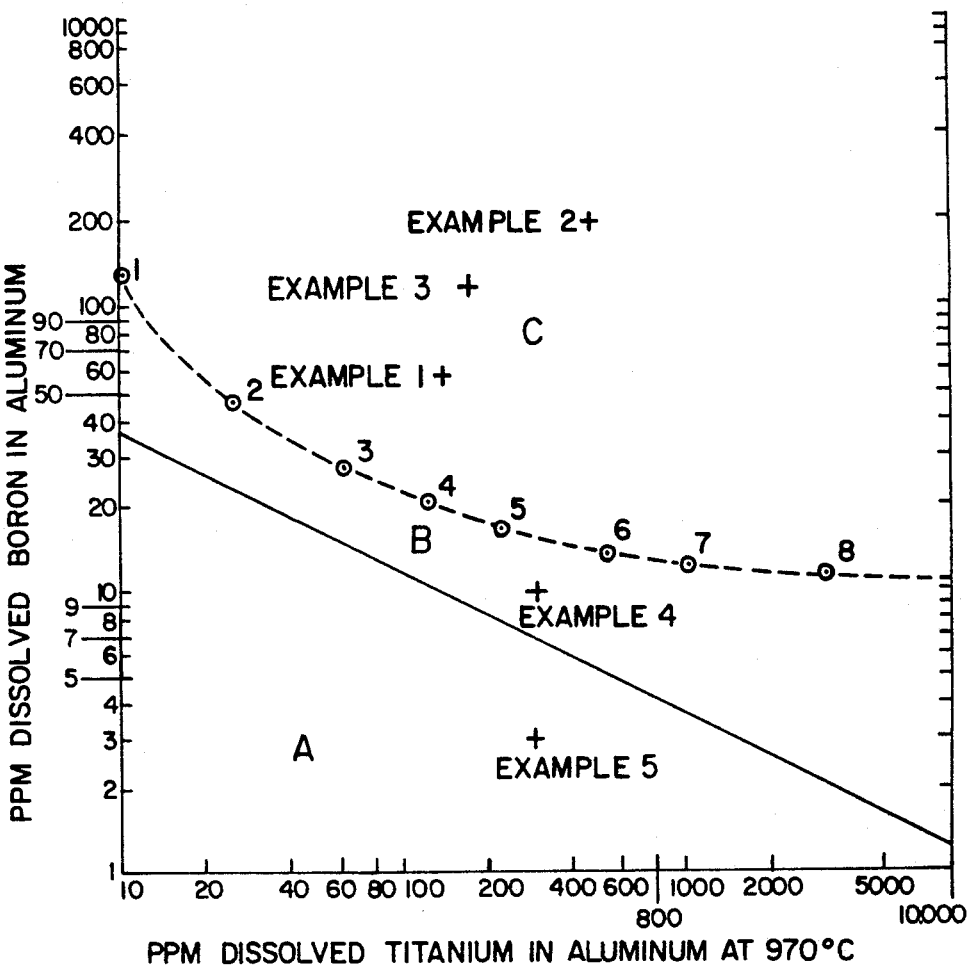
FIG. 6 shows the solubility of titanium and boron in molten aluminum at 970° C. as well as the preferred range of titanium diboride supersaturations.

FIG. 6 shows the logarithmic solubility diagram for titanium and boron dissolved in molten aluminum at 970° C. The concentrations of boron and titanium are shown for a range from 10 to 1000 parts per million boron and from 10 to 5000 parts per million titanium.

For any composition in zone A, boron, titanium metal, and titanium diboride will dissolve in aluminum metal. The dashed line on FIG. 5 is drawn for a cathode current density of 1.0 Ampere per square centimeter. Above the dashed line, sufficient boron and titanium is deposited in the aluminum metal to deposit titanium diboride on the titanium metal surface at a rate exceeding 0.01 centimeters per year. For lower cathode current densities, new dashed lines further away from zone A can be drawn for a titanium diboride deposition rate of 0.01 centimeters per year. For higher cathode current densities, dashed lines closer to zone A can be drawn for titanium deposition rates of 0.01 centimeters per year. In zone B, above the solubility product line for titanium diboride and below the dashed line, titanium metal may be exposed to molten aluminum metal for prolonged periods of time before being coated by titanium diboride. In zone C, above both the solubility product line for titanium diboride and the dashed line, a titanium diboride coating deposits on the titanium metal cathode substrate by the process of supersaturation plating, at a rate greater than 0.01 centimeters per year.

Figure 7:
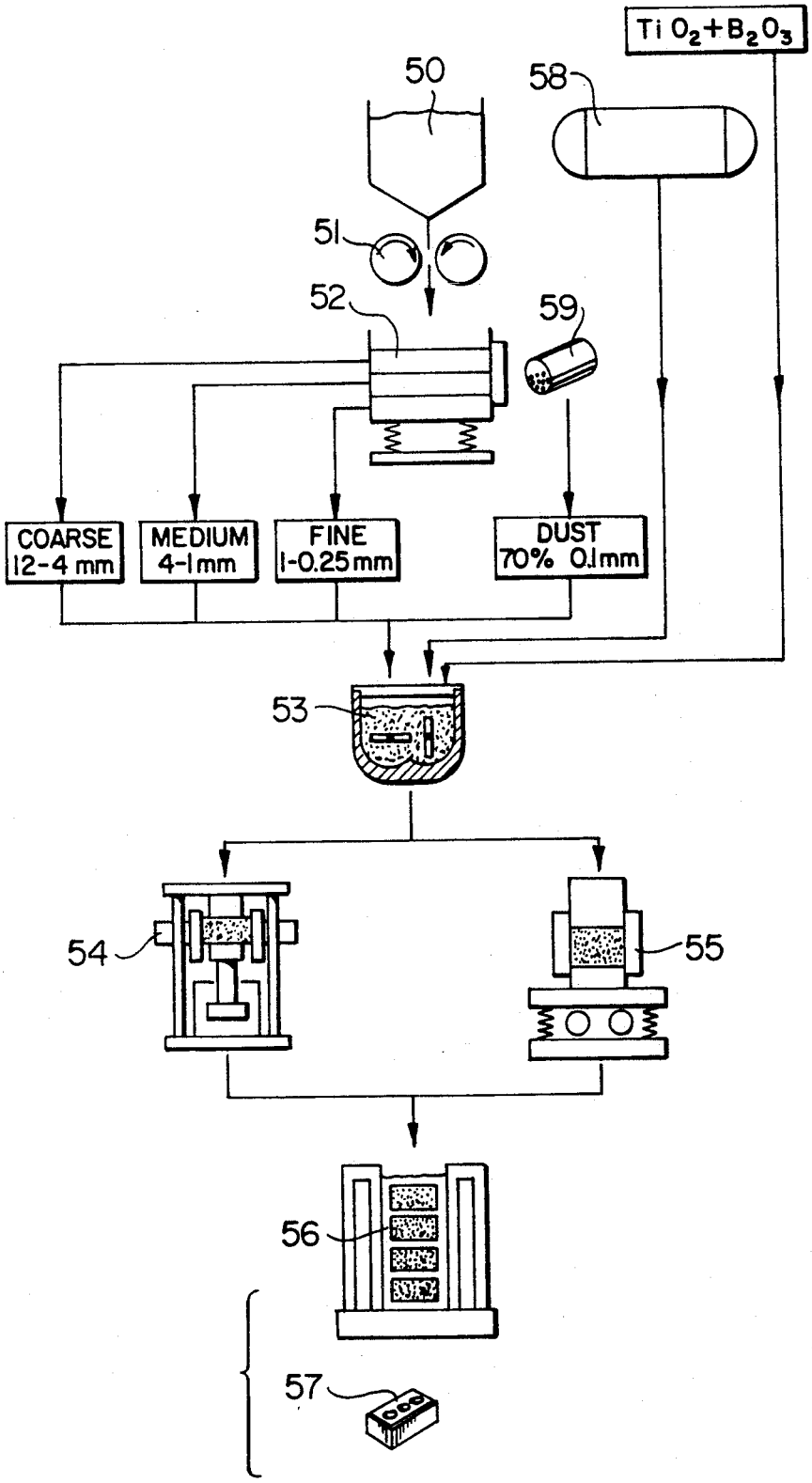
FIG. 7 is an anode production flow sheet showing the production of an anode useful in the present invention.

FIG. 7 shows a schematic anode production flow diagram wherein titanium oxide and boron oxide are mixed with pitch and coke to incorporate $TiO_2$ and $B_2O_3$ into the baked anode blocks. Fresh coke and anode butts 50 are crushed to below 12 millimeters in size in the crusher 51 and separated into several size fractions by the screen 52. Coke size fractions are blended with coke dust from the ball mill 59, pitch 58 and $TiO_2+B_2O_3$ in the mixer 53. Anode blocks 57 are formed in either the anode hydraulic press 54 or vibrating press 55 and then baked in the furnace 56. As the anode is attacked by the process of electrowinning aluminum from aluminum oxide dissolved in cryolite in the aluminum reduction cell, titanium and boron ions are dissolved in the cryolite and electrowon as elements in the electrowon aluminum metals to produce a supersaturated solution with molten aluminum. A prebaked anode useful in the present invention and produced by the process of the flow sheet will have 0.005% to 13% by weight $TiO_2$ and 0.003% to 6% by weight $B_2O_3$. The remainder of the anode is composed of carbon with some residual impurities such as sulfur, vanadium, iron, nickel, silicon, and sodium. Meta and ortho boric acids fed to the green anode mix will decompose to $B_2O_3$ during calcining of the anode. Titanium carbide and boron carbide may be substituted for chemicals containing or that decompose to titanium dioxide and boron oxides in forming the anode. Titanium and boron carbides survive the anode baking process but are decomposed by the anodic process in the cell. Titanium and boron ions are then dissolved in the cryolite. Titanium carbide and boron carbide can not be added directly to the cryolite cell as these chemicals are not soluble in cryolite.

Titanium and boron ions may be added directly to the cryolite electrolyte of the present inventive method in the form of oxides and fluorides. The preferred form of titanium containing chemical is titanium oxide. Unrefined titania ($TiO_2$) in the form of rutile or anatase may also be used as a source of titanium ions in the bath. Boron may be added in the form of oxides, fluorides, titanates and titanium boron glass-like materials. The preferred boron containing chemicals are meta boric acid ($HBO_2$), ortho boric acid ($H_3BO_3$), however various boron containing chemicals including boron oxide ($B_2O_3$) and sodium boron oxides such as sodium metaborate, sodium tetraborate may serve as well.

Boron oxides and titanium oxides, or salts may be fed continuously to the electrolyte by being premixed with the ore, may have separate addition feeders and can be hand fed. Boron and titanium oxides, carbides, salts or even titanium diboride may be mixed with the carbon and pitch used to make the carbon anodes. If at least one of the several individual anodes in the cell contains titanium and/or boron, titanium and boron are continuously released at a uniform rate to the cryolite bath as the anodes are burned off by the smelting process. It is not necessary that all anodes contain both titanium and boron. It is possible to feed titanium and boron at a continuous and uniform rate as long as one or more anodes contain titanium and one or more contains boron. A uniform and continuous supersaturation of titanium diboride in the electrowon aluminum may be achieved by any of the above feeding methods.

With reference to FIG. 1, 2, 3 and 4, the improved drained cathode aluminum reduction cells operate with the bottom surfaces of the anodes 24 and 25 nearly parallel to the top surfaces of the cathodes 29, 35, 63 and 73. Both cathodes and anodes are typically sloped from the horizontal by between 2 and 15 degrees and preferably between 5 and 10 degrees to make the laminar film of electrowon aluminum metal, 40 run down the sloped surface of the cathode and to make the carbon dioxide bubbles 31 produced by the electrolysis of the anodes 24 and 25 flow upwards against the bottom surface of the anodes to pump the molten cryolite electrolyte 32 up slope within the vertical gap between the cathodes and anodes. The molten cryolite electrolyte 32 rises up the sloped space between the cathodes and anodes because of both gas lift pumping and an additional buoyancy effect resulting from reduced density of the cryolite in the gap between the cathodes and the anodes due to heating resulting from polarizations and the electrical resistivity of the cryolite. Sufficient heat is generated, by the flow of electricity through the molten electrolyte and through the carbon and metal parts of the cell, and from electrochemical polarizations on the electrode surfaces to heat the cryolite by several degrees as it passes up the slope between the anodes and cathodes. Circulation of the molten cryolite electrolyte brings freshly dissolved alumina ore, $Al_2O_3$ into contact with the anodes and cathodes. Alumina ore is periodically introduced into the cryolite electrolyte 26 by opening the valve 17 on the storage bin 16 and by breaking the frozen cryolite crust 27 with the crust breaker bar 18. Point feeders for alumina can also be beneficially employed. Alumina is required to supply aluminum ions to the cell that ca be electrowon to become aluminum metal and to supply oxygen ions to the cryolite which are required to sustain the desired anode reaction that produces carbon dioxide gas, and to avoid the undesirable, so called anode effect.

The anodes in the improved cell may be either carbon or an electrically conductive permanent anode that is sparingly soluble in cryolite. The electrowinning smelting process generates carbon dioxide on carbon anodes and oxygen gas on ceramic anodes.

The inventive cathode coating method allows departures from the arts described in prior art patents that describe aluminum reduction cells with titanium diboride drained cathode coatings that must be installed at the time of cell construction. Drained cathode cells using the present inventive coating procedure may be constructed according to FIG. 1 with the elevated cathode block structures cut to the desired slope for cell operation but unlike prior art patents does not have a brittle titanium diboride cathode coating installed at the time of construction. A cell constructed according to FIG. 1 may be heated to operating temperature by any means that avoids significant oxidation of the titanium plates, attached to the cathode structure. A cell constructed according to FIG. 3 may be heated by any procedure that avoids burning of the carbon cathode structure because the titanium cathode structures may be inserted into the cell after it has been heated to its operating temperature. Both gas burner and electrical resistance heating may be used to heat the inventive cells. Uniform rapid heating of the inventive cells may also be rapidly attained by pouring molten cryolite electrolyte and aluminum metal into the cold cell.

Electrolysis in cells using the inventive coating method are best started on full line current as soon as the molten cryolite is placed in the cell. In order to prevent the titanium cathode substrate from being attacked by the electrowon molten aluminum metal, it is necessary, to operate the cell to produce aluminum compositions that fall within zones B or C of FIG. 6. To start a titanium diboride coating at a rate in excess of 0.01 centimeters per year, the boron concentration must be greater than 25 part per million in the electrowon aluminum to establish zone C compositions at a cathode current density of 1.0 Ampere per square centimeter. Because the titanium diboride supersaturation is significant, the electrowon aluminum metal will quickly wet the cathode surface without attacking the titanium substrate.

During operation of a drained cathode aluminum reduction cell depicted in FIG. 1, about one half of the amount of electrowon supersaturating titanium and boron is deposited on the cathode surface before the aluminum drains into wells 42 which are built into the cathode cavity, adjacent to the drained cathode surfaces 21 and 36. The aluminum metal deposits the remainder of the supersaturating concentrations of refractory metals and boron in the metal holding wells. Because the surface area of the wells 42 holding aluminum metal 10 is by necessity only about one quarter of that of the cathode surface, the rate of growth of titanium diboride in the metal wells is about four times as fast as on the cathode surface. The thickness of the titanium diboride deposits that can be grown on titanium metal cathode surfaces attached directly to the cathode blocks over the useful life of the cell is limited to about one centimeter to avoid excessive loss of metal reservoir capacity in the metal wells which would increase the frequency that aluminum metal must be tapped from the cell.

The titanium cathode structures illustrated in FIG. 4 may be placed in the cell after it is started in order to convert a conventional configuration of aluminum reduction cell to one with the drained cathode configuration illustrated in FIG. 3. The converted cell is operated in same manner as the cell illustrated in FIG. 1. The cell depicted in FIG. 3 has operational advantages over the cell depicted in FIG. 1 because the space under the cathodes accommodates more aluminum metal than may be accommodated in metal wells and cryolite may freely circulate under the cathode structures. The cryolite that is pumped up the slope in the gap between the cathode and anode is free to return to the bottom of the slope under the cathode structures in the cell configuration depicted in FIG. 3. This cell configuration allows anodes to be placed closer together than is permitted in the cell configuration depicted in FIG. 1 because the space provided under the cathode structures provides a path for the cryolite to return from the top to the bottom of gap between the anode and the cathode. In the cell depicted by FIG. 1 the return path is restricted to that available between the anodes. Holes in the top surfaces of the cathodes aids in the free circulation of the cryolite. The free circulation of cryolite under the cathode structures also helps to heat cold replacement anodes to the cell operating temperature.

Supersaturation plating of titanium diboride on the titanium cathode substrate should continue throughout most of the life of the cell to ensure that the cathode substrate will not be damaged. The composition of the aluminum deposited on the cathode is regulated by controlling the rate of addition of titanium ions and boron ions to the cryolite to produce aluminum metal containing minimum titanium and boron concentrations to form additional titanium diboride coating on the cathode surface at the rate of at least 0.01 centimeters per year. The ratio of titanium to boron electrowon in the aluminum metal can be maintained near the stoichiometric ratio so that the aluminum tapped from the cell has titanium and boron concentrations that, without further treatment, fall within analyses permitted in most commercial aluminum alloys. Additional boron may be electrowon into the aluminum metal while following this inventive coating method so that the metal tapped from the cell contains sufficiently low concentrations of titanium and other refractory metals that it can be used as electrical conductors without further treatment.

To produce a continuous and relatively thick titanium diboride coating on the cathode surface, the titanium and boron concentrations in the electrowon aluminum are set to compositions that fall well above the dashed line separating zones B and C of FIG. 6. If the titanium concentration in the electrowon aluminum is raised above about 200 part per million titanium, exposed cathodically polarized carbon around the cathode structures and around the cell perimeter develops a protective titanium carbide and titanium diboride coating instead of forming aluminum carbides. Coated carbon is relatively protected from attack by the electroreduced aluminum metal.

Variations in the concentrations of electrowon boron and titanium in the laminar aluminum film on the cathode from time to time are not usually harmful. Occasional aluminum metal composition excursions to lower boron compositions where the composition of the aluminum falls within zones B causes little harm. The average net rate of growth of the titanium diboride coating in zone B is merely reduced below 0.01 centimeters per year.

If the boron and titanium concentrations in the electrowon aluminum metal is set to compositions that fall within zone A for a prolonged period of time, the titanium diboride coating on the titanium metal cathode substrate can be thinned or lost. Because the normal average rate of dissolution of the titanium diboride without the addition of titanium ions and boron ions to the cryolite may be as low as 0.04 centimeters per year, some period of time usually elapses before there is a noticeable loss of titanium diboride coating. Operation of the cell, with aluminum chemistries falling in zone A of FIG. 6, may however cause titanium diboride coatings on the cathode to be lost, and the titanium metal cathode substrate may then be severely attacked.

The coatings deposited by supersaturation plating may be either a relatively pure titanium diboride or a mixture of refractory metal borides. All mixtures and alloys of refractory metal borides are wetted by molten aluminum metal and are suitable cathode coatings.

SPECIFIC EXAMPLES

Example 1

Titanium and boron oxides, or salts are added to the cryolite electrolyte of a drained cathode aluminum reduction cell to electrowin aluminum with a composition of 140 parts per million titanium and 60 parts per million boron. This composition falls above the dashed line within zone C of FIG. 6. In the absence of vanadium impurities in the anode, relatively pure titanium diboride deposits on the solid cathode surface at the rate of about 0.05 centimeters per year. Most of the remainder of the titanium and boron deposits in the metal holding wells or under the titanium structure cathodes of the aluminum reduction cell to an equilibrium defined by the solubility product of titanium diboride so that the metal tapped from the cell has a titanium concentration of only about 20 parts per million.

Example 2

Titanium dioxide and boric acid are added to the cryolite of a drained cathode aluminum reduction cell such to produce aluminum with a composition of 520 parts per million titanium and 235 parts per million boron. This composition falls within zone C of FIG. 6 and is also above the dashed line. The aluminum metal that deposits on the titanium cathode structure is supersaturated with respect to titanium diboride. Titanium diboride deposits on the solid cathode surface at the rate of about 0.24 centimeters per year. Titanium dioxide and boric acid is mixed with the coke used to make the anode. 2.33 kilograms of titanium dioxide and 4.00 kilograms of ortho boric acid, $H_3BO_3$ are mixed with each 1000 kilograms of petroleum coke and anode butts used to manufacture the anode.

Most of the titanium and boron that does not form coatings on the cathode surface forms deposits in the metal holding wells or holding area under and around the titanium cathode structures of the aluminum reduction cell so that the metal tapped from the cell contains only about 40 parts per million titanium and 18 parts per million boron. This example gives compositions for nearly the maximum rate of build up of titanium diboride deposits that can be sustained over the normal life of a FIG. 1 cell configuration without excessively decreasing the volume available for the storage of aluminum metal between cell taps. If the volume in the metal wells or holding areas under cathode structures is excessively diminished, the cell has to be tapped too frequently for economical plant operation.

Example 3

Titanium and boron oxides, or salts are added to the cryolite electrolyte of a drained cathode aluminum reduction cell to electrowin aluminum with a composition of 180 parts per million titanium and 100 parts per million boron. This composition falls above the dashed line within zone C of FIG. 6. The aluminum metal is supersaturated with respect to titanium diboride. Relatively pure titanium diboride, which may be found to be mixed with vanadium borides due to vanadium impurity in coke used to manufacture the anodes, deposits on the solid cathode surface at the rate of about 0.08 centimeters per year. Most of the remainder of the supersaturating concentrations of titanium and boron deposits in the metal holding wells or holding area under titanium cathode structures to an equilibrium defined by the solubility products of vanadium borides and titanium diboride so that the metal tapped from the cell has a titanium concentration of less than 20 parts per million.

Titanium dioxide and boric acid are mixed with the coke used to make the anode. 0.81 kilograms of titanium dioxide and 1.55 kilograms of ortho boric acid per 1000 kilograms of baked anode are mixed with the coke and coal tar pitch and pressed into green anodes. The anodes are calcined, hanger rod attached and placed into the cell. The titanium and boron are continuously fed to the cryolite bath as the anode is burned away by the electrowinning process.

Example 4

Titanium and boron oxides are added to the cryolite electrolyte of a drained cathode aluminum reduction cell to electrowin aluminum with a composition of 300 parts per million titanium and 10 parts per million boron. This composition falls within zone B of FIG. 6 and is below the dashed line. Titanium diboride deposits in patches on the titanium metal cathode substrate at a rate of about 0.003 centimeters per year. Many areas of the cathode surface are not continuously covered by titanium diboride. These areas are not dissolved away because the aluminum metal is still supersaturated with titanium diboride.

Example 5

Titanium and boron oxides are added to the cryolite electrolyte of a drained cathode aluminum reduction cell to produce aluminum with a composition of 300 parts per million titanium and 3 parts per million boron. This composition falls within zone A of FIG. 6. A titanium metal cathode surface is not coated by titanium diboride but is rapidly dissolved away because an additional 1200 parts per million titanium is dissolved by the molten aluminum from the titanium cathode structure to satisfy the solubility product of titanium diboride. The titanium cathode substrate is dissolved away at an average rate exceeding 1 centimeter per year.

The preferred refractory metal cathode substrate is titanium and the preferred metal boride coating is titanium diboride. It is preferable to maintain relatively small supersaturations of dissolved refractory metal and boron in the laminar film of molten aluminum metal to produce smooth and protective refractory boride coatings. A minimum rate of titanium diboride deposition of 0.01 centimeters per year is normally required to coat over occasional mechanical damage and maintain a continuous boride coating on the titanium metal substrate.

Very large amounts of refractory metal oxide and boron oxide, or refractory metal carbide and boron carbide, or refractory metal salt and boron salt, or some combination thereof, should not be added to the cell to avoid codepositing very large supersaturations of refractory metal and boron into the molten aluminum metal. Large supersaturations of refractory metal and boron will result not only in depositing too much refractory metal and boron in the metal holding areas below the titanium cathode structures but may also result in homogeneous nucleation of titanium diboride particles within the laminar aluminum layer. Homogeneously nucleated particles may cause roughening of the cathode surface. At very high supersaturations, tree-like refractory metal boride crystals may grow that protrude out of the laminar film of aluminum. Rough titanium diboride deposits can disrupt the thin film of aluminum metal on the drained cathode surfaces and interfere with the smooth flow of cryolite electrolyte.

OPERATION OF PRIOR ART METHODS

Aluminum metal, tapped from production cells having titanium diboride cathode coatings, installed at the time of cell construction according to prior art patents, produce aluminum metal with titanium and boron compositions that fall on or just below the titanium diboride solubility product line separating zones A and B of FIG. 6. Aluminum metal tapped from these cells is usually found to contain relatively more titanium and relatively less boron than the stoichiometric ratio. Most of this titanium and boron is dissolved from the titanium diboride structures that were physically placed in the cell. It is known that the rate of dissolution of titanium diboride from these structures may be retarded by adding solubility suppressors in the form of from 10 to 30 parts per million boron and/or from 10 to 50 parts per million titanium to the aluminum in the cell (Ransley U.S. Pat. No. 3,028,324). This titanium and boron is added to the pool of aluminum metal in the form of metallic boron or borides and metallic titanium which is sacrificed to provide some of the titanium and boron required to satisfy the titanium diboride solubility product so that relatively less of the more expensive titanium diboride structural elements that are placed in the cell is dissolved by the electrowon molten aluminum.

Alumina ores used to feed aluminum reduction cells may contain up to 80 parts per million of titanium oxide impurity. About one half of the titanium from the titanium oxides or salts fed to conventional cells with alumina ore is normally lost to gasses emitted by the cell, the aluminum produced from this alumina ore by conventional aluminum reduction cells would normally contain about 60 parts per million titanium. Up to two parts per million boron of boron impurities may enter the electrowon aluminum metal mainly from impurities in the anode coke. These natural titanium and boron impurities are not sufficient to saturate the aluminum metal with respect to titanium diboride at 970° C.

In conventional aluminum cells employing a metal cathode pool, boron oxides have been added to the cryolite for the purpose of reducing the concentrations of dissolved heavy metals in the aluminum tapped from the cells (Karnauklov et al, Soviet Non-Ferrous Metals Research Translation Vol. 6, No. 1, pp 16–18 1978). Enough boron oxide may be added to the cryolite electrolyte so that aluminum deposited on the top surface of the aluminum pool exceeds the solubility product of titanium diboride but because titanium diboride grows on the surfaces of vast numbers of suspended tramp nuclei in the molten aluminum pool, the average composition of the several tons of molten aluminum metal in the cathode pool never exceeds the solubility product of titanium diboride by any significant amount. No titanium diboride deposits have been found on the carbon cathode liner of these conventional cells.

Sane et al in U.S. Pat. No. 4,560,448 fed titanium diboride mixed with the alumina ore into the molten aluminum pool of a conventional aluminum reduction cell in attempts to produce near saturated concentrations of dissolved titanium and boron. This procedure was originally disclosed by Ransley in U.S. Pat. No. 3,028,324. The titanium diboride dissolves in the aluminum pools and acts as a solubility suppressor for titanium diboride coatings on ceramic oxide packing.

One embodiment of U.S. Pat. No. 4,560,448 by Sane et al is to form titanium diboride coatings on the surfaces of ceramic oxide packing bed elements by first coating the ceramic elements with a layer of a mixture of titanium oxide and boron oxides. These oxides are converted to a mixture of aluminum oxide and titanium diboride by the process of aluminothermic reduction, achieved by submerging the ceramic elements in molten aluminum metal. The cathode pool of aluminum metal in the aluminum reduction cell may provide an adequate molten aluminum pool to carry out the aluminothermic reaction process required by Sane et al but any deep pool of aluminum metal would suffice.

The present inventive method differs from that of Sane et al because it forms thick, non porous coatings of titanium diboride that are not mixed with aluminum oxide. The present inventive method may only be practiced in thin films of molten aluminum metal on drained cathode substrates. The present inventive method of coating is achieved by continuously dissolving titanium ions and boron ions into cryolite based electrolyte and electrowinning supersaturation concentrations of elemental titanium and boron into a thin laminar film of molten aluminum.

Another method used by Sane et al for coating alumina substrates with a film of titanium diboride is to first coat the substrate with titanium metal and then place it in a pool of aluminum metal, unsaturated with titanium and boron. The boron in the pools reacts with the titanium metal on the alumina substrate and converts it to titanium diboride. The present inventive method takes both titanium and boron from a film of aluminum metal to deposit titanium diboride coatings on titanium metal cathode substrates.

I claim:

1. A method of coating a raised cathode surface in a raised cathode type reduction cell during the production of aluminum comprising the steps of:

charging said cell with a solution of dissolved aluminum oxide, and dissolved ions containing a metallic element selected from the group consisting of titanium, zirconium, hafnium, chromium, vanadium, niobium, tantalum, molybdenum, tungsten or mixtures thereof and dissolved ions containing boron, in molten cryolite electrolyte;

electrowinning from said molten cryolite electrolyte, molten aluminum metal containing concentrations of said dissolved metallic element or mixtures thereof, and boron which together supersaturate said molten aluminum metal with the boride or mixture of borides of said metallic elements;

passing said molten aluminum metal across a raised surface of said cathode, said raised cathode surface comprising a metal substrate chosen from the group consisting of titanium, zirconium, hafnium, chromium, vanadium, niobium, tantalum, molybdenum, tungsten and alloys thereof; and depositing on said raised cathode surface a coating of a boride of said metallic element or mixture of borides of said metallic elements.

2. The method of claim 1, wherein:

said metallic substrate and said metallic element comprises zirconium.

3. The method of claim 1, wherein:

said metallic substrate and said metallic element comprises niobium.

4. The method of claim 1, wherein, said metallic substrate and said metallic element comprises titanium.

5. The method of claim 1, wherein:

said coating is comprised of titanium diboride.

6. The method of claim 1, wherein:

said coating is between 5 angstroms and 5 centimeters in thickness.

7. A method of maintaining an aluminum wetted coating on a drained cathode surface of an aluminum reduction cell while aluminum is being smelted from a solution of aluminum oxide dissolved in molten cryolite, comprising the steps of:

charging said cell with a solution of dissolved aluminum oxide, and dissolved ions containing a metallic element, selected from the group consisting of titanium, zirconium, hafnium, chromium, vanadium, niobium, tantalum, molybdenum, tungsten or mixtures thereof, and dissolved ions containing boron, in molten cryolite electrolyte;

electrowinning from said molten cryolite molten aluminum metal containing concentrations of said dissolved metallic element and boron which together supersaturate said aluminum metal with the boride or mixture of borides of said metallic elements;

allowing said molten aluminum metal to drain across a raised surface of said cathode, said raised cathode surface comprising a metal substrate chosen from the group consisting of titanium, zirconium, hafnium, chromium, vanadium, niobium, tantalum, molybdenum, tungsten or alloys thereof; and depositing on said raised cathode surface a coating of a boride of said metallic element or mixture of borides of said metallic elements.

8. The method of claim 7, wherein:

said metallic substrate and said metallic element comprises titanium.

9. The method of claim 7, wherein:

said coating is comprised of titanium diboride.

10. A method of operating a raised cathode type aluminum reduction cell comprising the steps of:

heating said cell to operating temperature;

charging said cell with a solution of dissolved aluminum oxide, and dissolved ions containing a metallic element, selected from the group consisting of titanium, zirconium, hafnium, chromium, vanadium, niobium, tantalum, molybdenum, tungsten or mixtures thereof, and dissolved ions containing boron, in molten cryolite electrolyte;

electrowinning from said molten cryolite electrolyte, molten aluminum metal containing concentrations of said dissolved metallic element or mixtures thereof, and boron which together supersaturate said molten aluminum metal with the boride or mixture of borides of said metallic elements;

passing said molten aluminum metal across a raised surface of said cathode, said raised cathode surface comprising a metal substrate chosen from the group consisting of titanium, zirconium, hafnium, chromium, vanadium, niobium, tantalum, molybdenum, tungsten or alloys thereof; and depositing on said raised cathode surface a coating of a boride of said metallic element or mixture of borides of said metallic elements.

11. The method of claim 10, wherein:

said metallic substrate and said metallic element comprises titanium.

12. The method of claim 10, wherein:

said coating is comprised of titanium diboride.

13. A method of operating a raised cathode type aluminum reduction cell comprising the steps of:

heating said cell to operating temperature;

charging said cell with a solution of dissolved aluminum oxide, and dissolved ions containing a metallic element, selected from the group consisting of titanium, zirconium, hafnium, chromium, vanadium, niobium, tantalum, molybdenum, tungsten or mixtures thereof, and dissolved ions containing boron, in molten cryolite electrolyte;

placing an anode into said mixture, said anode being comprised of carbon and 0.05 to 13% by weight titanium dioxide and 0.015 to 5% by weight boron oxide;

conducting direct electrical current through said anode into said mixture producing carbon dioxide on said anode and dissolving said titanium dioxide and said boron oxide in said molten cryolite electrolyte;

electrowinning from said molten cryolite electrolyte, molten aluminum metal containing concentrations of said dissolved metallic element or mixtures thereof and boron which together supersaturate said aluminum metal with the boride or mixture of borides of said metallic elements;

passing said molten aluminum metal across a raised surface of said cathode comprising a titanium metal substrate; and depositing on said raised cathode surface a coating of titanium diboride.

14. The method of claim 13, wherein:

said metallic substrate and said metallic element comprises zirconium.

15. The method of claim 13, wherein:

said metallic substrate and said metallic element comprises niobium.

16. The method of claim 13, wherein:

said metallic substrate and said metallic element comprises molybdenum.

17. The method of claim 13, wherein:

said coating is between 5 angstroms and 5 centimeters in thickness.

* * * * *